US006047962A

United States Patent [19]

Popadiuk

[11] Patent Number: 6,047,962

[45] Date of Patent: Apr. 11, 2000

[54] AMUSEMENT GAME WITH PINBALL PLAYFIELD AND COMBINED FLIPPER/ FOUR-WAY SWITCH

[75] Inventor: John A Popadiuk, Bartlett, Ill.

[73] Assignee: Williams Electronics Games, Inc., Chicago, Ill.

[21] Appl. No.: 09/099,964

[22] Filed: Jun. 19, 1998

[51] Int. Cl.[7] ..... A63F 7/02

[52] U.S. Cl. ..... 273/119 A; 273/121 A

[58] Field of Search ..... 273/118 R, 118 A, 273/119 R, 119 A, 121 R, 121 A

[56] References Cited

U.S. PATENT DOCUMENTS

| | | | |
|---|---|---|---|
| D. 408,366 | 4/1999 | Popadiuk | D13/158 |
| 3,659,284 | 4/1972 | Rusch . | |
| 3,672,674 | 6/1972 | Reed . | |
| 3,778,058 | 12/1973 | Rausch . | |
| 4,256,931 | 3/1981 | Palisek . | |
| 4,355,805 | 10/1982 | Baer et al. . | |
| 4,373,725 | 2/1983 | Ritchie | 273/121 A |
| 4,375,286 | 3/1983 | Seitz et al. | 273/121 A |
| 4,520,240 | 5/1985 | Swindler . | |
| 4,632,341 | 12/1986 | Repperger et al. . | |
| 5,126,731 | 6/1992 | Cromer, Jr. et al. . | |
| 5,137,277 | 8/1992 | Kitaue . | |
| 5,150,899 | 9/1992 | Kitaue . | |
| 5,257,179 | 10/1993 | DeMar . | |
| 5,284,342 | 2/1994 | Tanzer et al. . | |
| 5,330,183 | 7/1994 | Gottlieb | 273/121 A X |
| 5,332,217 | 7/1994 | Gottlieb | 273/121 A |
| 5,342,049 | 8/1994 | Wichinsky et al. . | |
| 5,356,142 | 10/1994 | Borg et al. . | |
| 5,365,026 | 11/1994 | Cromer, Jr. et al. . | |
| 5,375,828 | 12/1994 | Shikami . | |
| 5,375,829 | 12/1994 | Lawlor et al. | 273/119 A X |
| 5,444,624 | 8/1995 | Wilkinson et al. . | |
| 5,507,488 | 4/1996 | Eddy et al. | 273/118 A X |
| 5,513,131 | 4/1996 | Wilkinson et al. . | |
| 5,533,727 | 7/1996 | DeMar . | |
| 5,536,911 | 7/1996 | Madill . | |
| 5,591,082 | 1/1997 | Jensen et al. . | |
| 5,611,731 | 3/1997 | Bouton et al. . | |
| 5,667,217 | 9/1997 | Kelly et al. . | |
| 5,683,082 | 11/1997 | Takemoto et al. . | |

*Primary Examiner*—Raleigh W. Chiu
*Attorney, Agent, or Firm*—Arnold White & Durkee

[57] ABSTRACT

An amusement game includes a number of elements in a cabinet defining pinball play, including a playfield and flippers for propelling a ball onto the playfield. At least one control device operates the flippers and other features of the amusement game. The control device is manually engageable in at least two different fashions for producing at least two types of control signals. One of these types of control signals is for controlling the flippers and another of these types of control signals is for controlling other features of the amusement game.

21 Claims, 4 Drawing Sheets

AMUSEMENT GAME WITH PINBALL PLAYFIELD AND COMBINED FLIPPER/ FOUR-WAY SWITCH

FIELD OF THE INVENTION

This invention relates generally to amusement games, and more particularly, to an amusement game having a pinball playfield and one or more combined flipper/four-way switch or joystick type control devices.

BACKGROUND OF THE INVENTION

Designers of amusement games such as pinball games strive to constantly provide innovations to continue to attract interest of the public in playing the games. The intent is to both attract new players and to retain the interest of present players. In pinball games, new and different playfields incorporating various features and corresponding artwork have been developed for attracting and retaining players.

Generally speaking, pinball games utilize a playfield in a generally horizontally disposed cabinet. The playfield is usually tilted or inclined at a slight angle from the horizontal to encourage return of the ball to one end of the playfield, where the skilled player may use flippers to attempt to propel the ball back into a playing area of the playfield. Usually, at least two flippers are provided, and each is controlled by means of a corresponding one of a pair of flipper buttons mounted to upper side portions of the cabinet near a player position located at the end of the cabinet at which the player stands.

Other types of control device such as joysticks or four-way switches have seldom heretofore been utilized in connection with pinball games. Such control devices are more often associated with video games which are generally played either as arcade games, or as home games using dedicated game playing devices coupled to ordinary television sets, or computer video games which are often played using a conventional computer keyboard, or a joystick or other specialized control device which is operatively coupled with the computer.

U.S. Pat. No. 5,342,049 (Wichinsky et al.) discloses a gaming machine in which the player propels a ball toward one or more targets. This gaming machine combines the features of a rotating reel slot machine with a pinball feature, the latter being activated when the player achieves a losing combination on the spinning reel slot machine. This allows the player a second chance to win if he can manipulate the ball into a position that will allow a further spin of the reels of the slot machine. This gaming machine includes an inclined surface over which the ball is propelled. A ball propelling device is controlled by the player by means of one or more push-buttons, or in one embodiment disclosed in this patent, by a joystick-like device which initially aims the ball propelling device and which is provided with an axially extending push-button button for firing the ball into the inclined playing surface. However, this "joystick" manipulates the ball shooter only to the right and to the left and is not operative as a "four way" device as in many video games. Moreover, the "joystick" is used only to mechanically aim and fire the ball shooter, in similar fashion to the plunger of a more conventional type of pinball machine, the only difference being the ability to control the direction in which the ball is initially propelled, rather than propelling the ball up a fixed lane as is the case with most conventional pinball machines.

U.S. Pat. No. 4,356,142 (Borg et al.) shows a pinball machine with a moveable ball transfer assembly. In this machine, a mechanism is provided which can retrieve the ball, move relative to the playfield and deposit the ball at different locations on the playfield. The disclosed embodiment of this device resembles an overhead crane or boom type of device. In one embodiment, this game is provided with a joystick by which the player can manipulate the ball transfer device or move the ball transfer device relative to the playfield.

The inventor is not aware of any pinball games which have provided any features using a four-way switch or joystick to any greater extent than the limited uses described in the two above-referenced patents. In the Borg et al. patent, conventional flipper switches are still utilized to control flippers in the pinball game in the fashion usually associated with pinball games. Thus, the flipper switches and the joystick are separate elements in the amusement game described in the Borg et al. patent. The Wichinsky et al. patent described above does not use flippers, but instead relies exclusively on the ball shooter and upon return of the ball to the ball shooter from the inclined playing field surface. Control features of the Wichinsky et al. patent control when the ball shooter is operative or inoperative, thus controlling the amount of play either by imposing a time limit or a limit upon the number of times the player may use the ball shooter to propel the ball into the playfield area.

SUMMARY OF THE INVENTION

One aspect of the invention provides a pinball game with a four-way switch control device which may alternatively operate as either a flipper switch for operating flippers of the pinball game or as a four-way switch or "joystick" for operating other game features.

Briefly, and in accordance with the foregoing, an amusement game comprises a cabinet, apparatus in said cabinet defining pinball play, including a playfield and flippers for propelling a ball onto the playfield, at least one control device for operating the flippers and other features of the amusement game, said control device being manually engageable in at least two different fashions for producing at least two different control signals, at least one of said at least two different control signals being for controlling said flippers and at least one other of said at least two different control signals being for controlling other features of said amusement game.

DESCRIPTION OF ILLUSTRATIVE EMBODIMENTS

Figure 1:
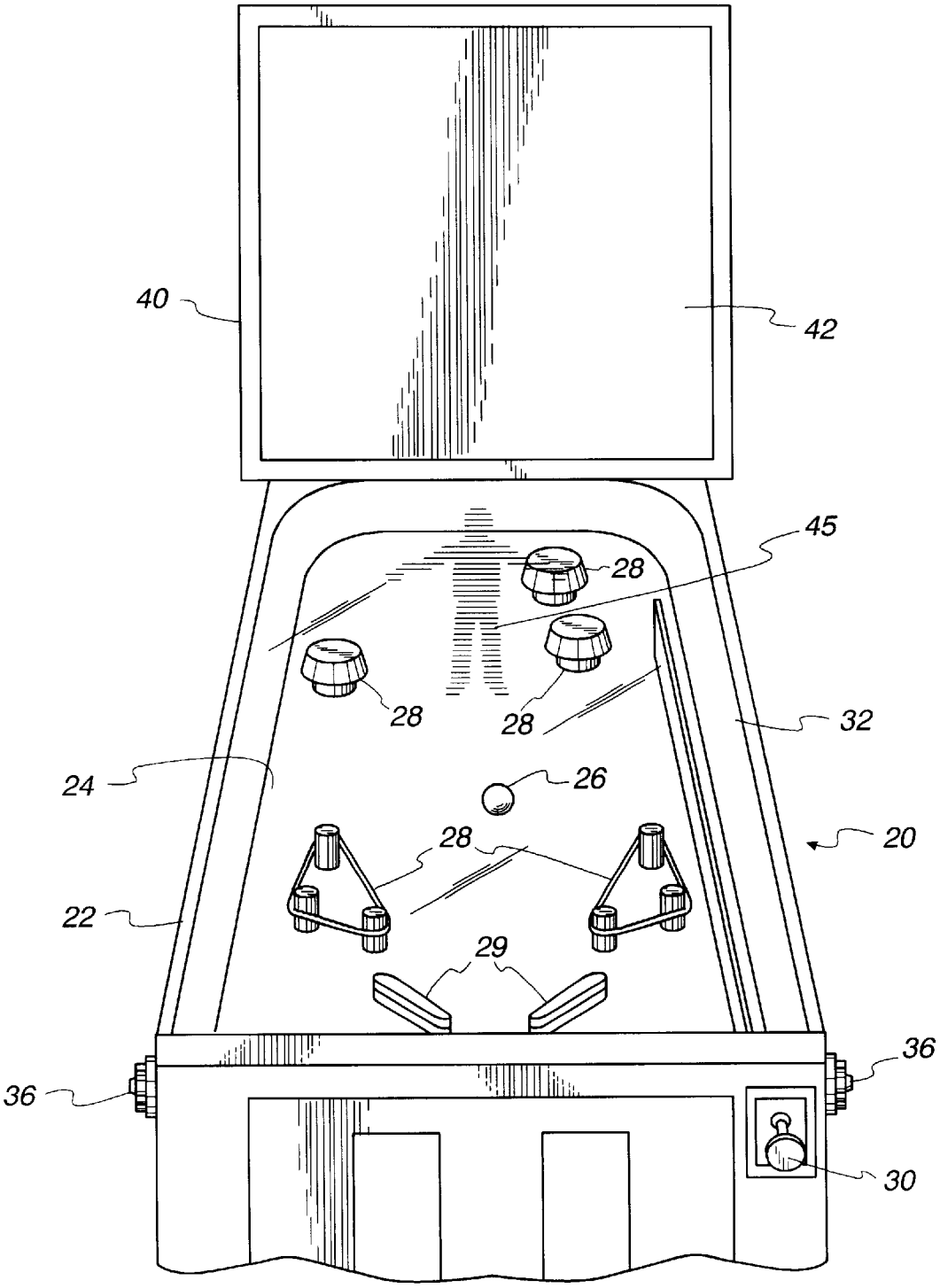
FIG. 1 is a front perspective view of a pinball machine in accordance with the invention.

While the invention is susceptible to various modifications and alternative forms, specific embodiments have been shown by way of example in the drawings and will be described in detail herein. However, it should be understood that the invention is not intended to be limited to the particular details disclosed. Rather, the invention is to cover all modifications, equivalents, and alternatives falling within the spirit and scope of the invention as defined by the appended claims.

Figure 2:
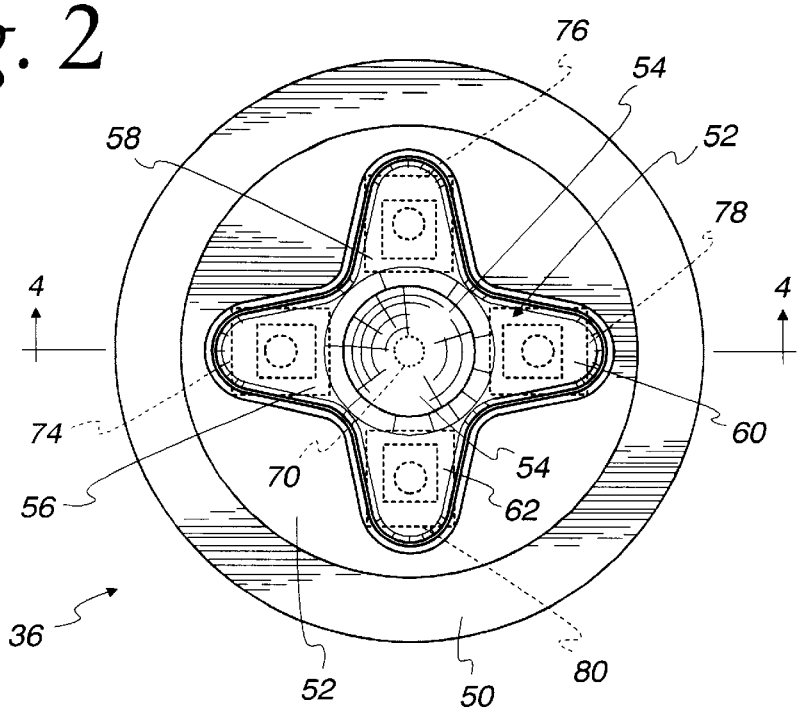
FIG. 2 is an enlarged top plan view of a control device in accordance with the invention.
Figure 3:
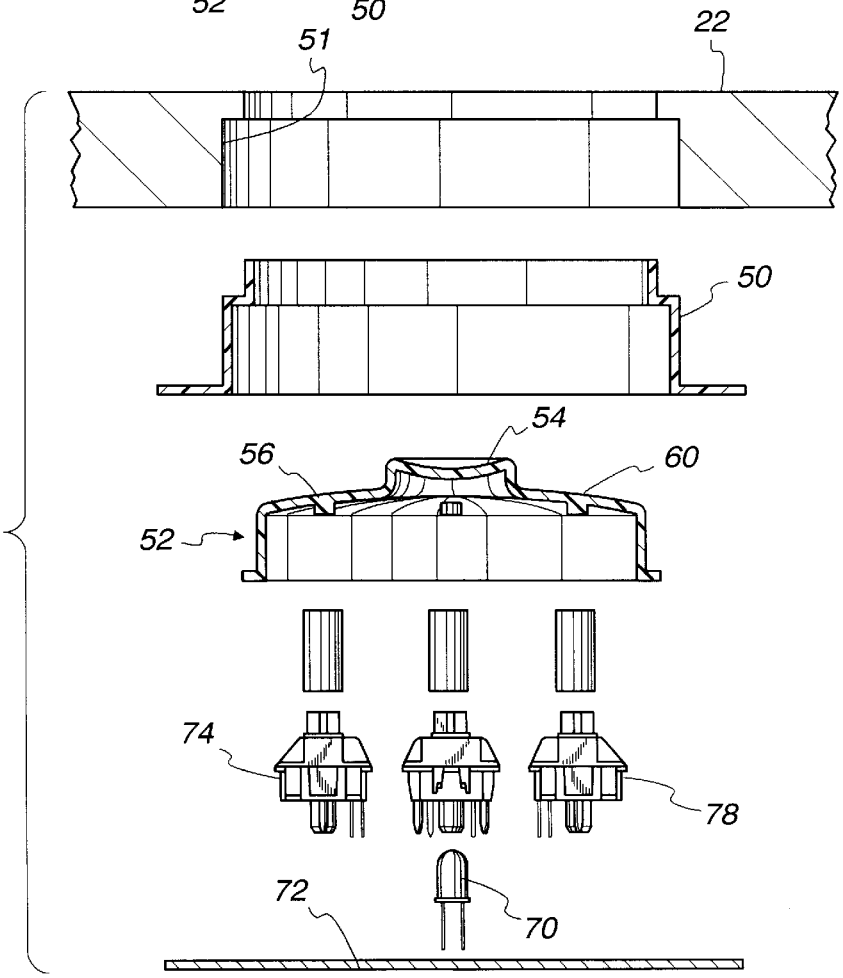
FIG. 3 is an exploded elevation showing the assembly of components of the device of FIG. 2.

Referring now to the drawings, and initially to FIG. 1, an amusement game in accordance with one embodiment of the invention is designated generally by the reference numeral 20. The game 20 includes a cabinet 22 which houses various apparatus for defining pinball play. Generally speaking, this apparatus includes a playfield 24 which incorporates a number of playfield accessories or devices 28. A pair of flippers 29 is usually provided for propelling a ball 26 onto the playfield 24. In this regard, and as best viewed in FIG. 2, the playfield 24 is usually inclined from the horizontal such that the ball 26 tends to eventually roll back down the playfield in the direction of the flippers 29. The player may use a pair of flipper buttons 36 located on the sides of the cabinet 22 to activate the flippers 29 and attempt to propel the ball 26 back into the playfield 24.

The playfield accessories or devices 28 may include elements such as various types of bumpers or targets as well as other elements or devices as generally known to pinball game designers. The playfield 24 may be covered by a transparent or glass sheet 32 to permit viewing of the playfield. The pinball machine 20 may include additional or different features in its playfield 24 without departing from the invention, the foregoing being by way of example only. In addition to the foregoing, the playfield usually includes a plunger element 30 which initially shoots the ball 26 up an alley 32 onto the playfield 24. In accordance with conventional practice, the pinball machine 20 also includes a backbox 40 which is mounted to overlay a top rear portion of the cabinet 22 and which may have artwork and/or a display 42 on its surface facing the player. Other types of displays may also be used.

For example, the back box 40 may mount a video element such as a CRT, LED or LED display, plasma display, LCD projector, video projector or the like which is located so as to project a virtual image 45 into the playfield. This is accomplished by providing at least a portion of the sheet 32 as a material which has both transparent and reflective qualities, and adjusting the angle and position of the CRT or projector relative to the sheet 32 so as to create the virtual image 45 at the desired location. As more fullly described in copending application Ser. No. 09/081,146 filed May 19, 1998 (attorney's docket WMSW008), this virtual image may be a video image which is interactive with features and/or the play of the pinball game. Reference to this copending application, which is hereby incorporated herein by reference, is invited for a further discussion of generation of a virtual image and the manner in which this can be done in an interactive fashion with the features and/or play of the game.

Departing from convention, and as more fully described below with reference to the remaining figures of drawings, each of the push-buttons 36 comprises a control device which is capable of being activated in one of at least two different fashions so as to produce one of at least two different types of switch signals or control signals. At least one of these types of switch or control signals is for controlling the operation of the flippers 29 while at least one of these types of the switch or control signals is for controlling other features of the amusement game.

The second type of switch or control signal produced by the push-button 36 may control a number of game features. In additions to activating the flippers 29, as is done with the first type of control signal, other physical or mechanical features of the game might be controlled by the second type of control signals. These mechanical features might include lane changes, the operation of various magnets, etc., for interacting with the ball 26, as well as other mechanical or electromechanical devices such as pop-up targets and the like. The push-button 36 may also interact with a suitable processor or controller or other control circuitry (not shown) located in the cabinet 22 for controlling various game-play options, lights, audio effects, the speed of game play, and the like.

The virtual image 45 may include various images related to the game as shown in greatly simplified form in FIG. 1, or may include game information or options or displays. In this connection, the one or more second types of control signal which may be produced by the push-button 36, as described more fully hereinbelow, may be used in the manner of a selector, to select various options from the game, for example selecting from a game menu displayed by the virtual display 45 or by a video or other type of display mounted in the backbox 40 facing the player directly. In connection with a display, such as the virtual display 45 or other display, the player might use one or more of the second types of signals produced by the buttons 36 to control, interactively, or otherwise, various features displayed in the virtual display or on a video display mounted on the back box 40 directly facing the player. This may include various options to, move, switch, morph or otherwise change various elements in the virtual or other display, as controlling or playing various elements in the display, which may include video or virtual flippers and other video or virtual equivalents of various pinball features included in the playfield 24, or in the playfields of other pinball games. These second types of signals produced by the buttons 36 might also be used by service personnel to control various options such as game test features, intelligent diagnostics, and other information to be sent or received via a network connection, modem, internet or the like to or from a manufacturer or distributor of the game, an online game server or virtual community, or the like, and to select such options as audio volume level, game language, country codes, pricing options, etc.

Figure 4:
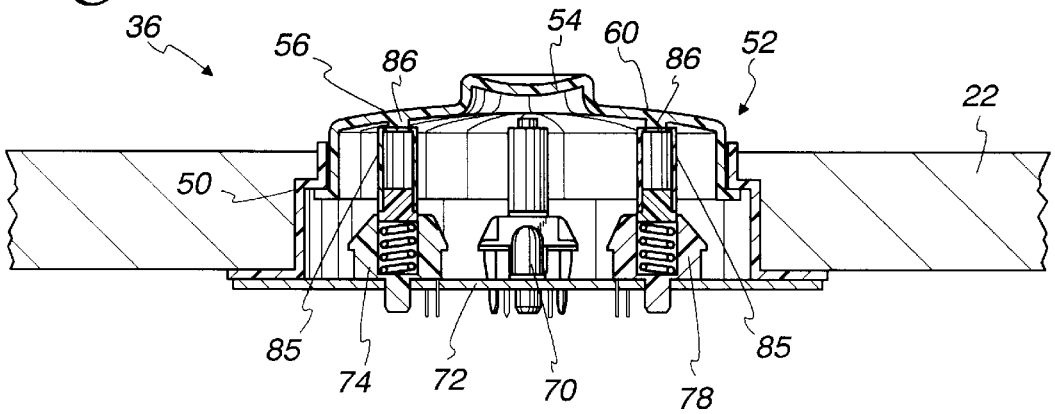
FIG. 4 is a sectional view generally taken on the line 4—4 of FIG. 2, and showing the device in an unactivated condition.
Figure 5:
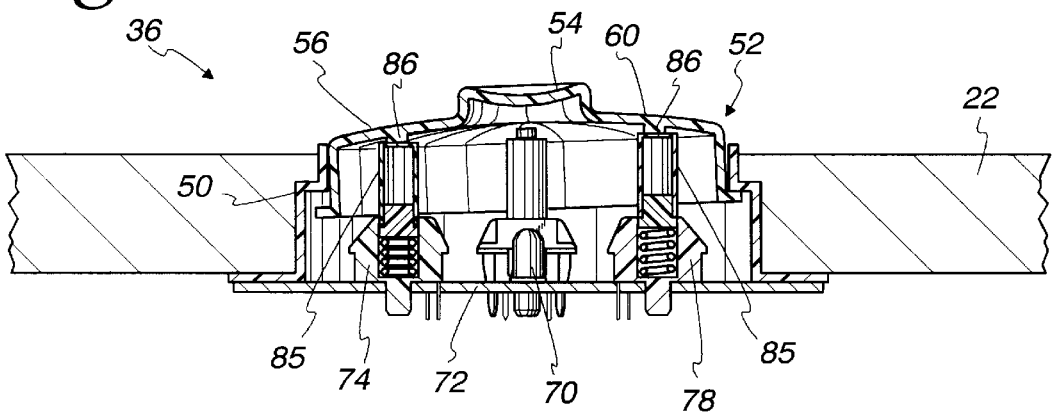
FIG. 5 is a sectional view similar to FIG. 3, showing one switch activated.
Figure 6:
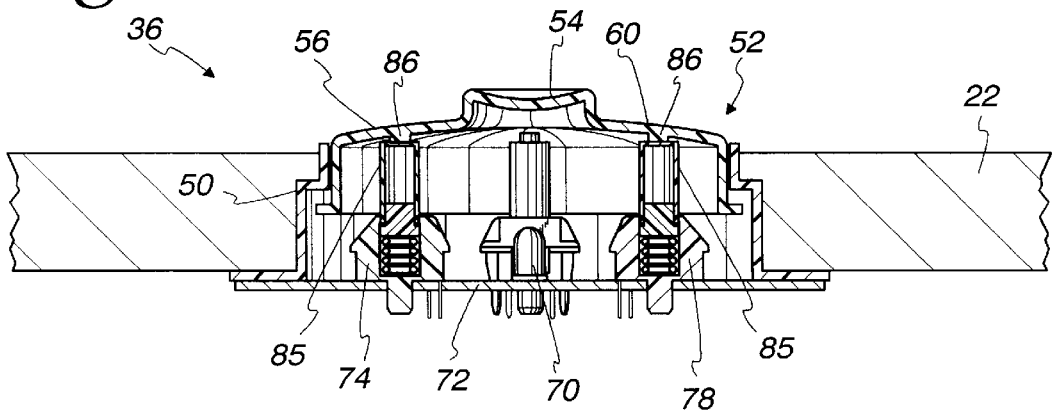
FIG. 6 is a sectional view similar to FIGS. 3 and 4, showing all switches activated.

Referring now to FIGS. 2 through 6, ftrther details of the control element or push-button 36 in accordance with the illustrated embodiment are shown, and will next be described. The control device or push-button 36 includes a housing 50 which is mounted to cabinet 22, and preferably recessed in an opening 52 provided in the cabinet such that only a small portion of the housing 50 extends above the outside surface of the cabinet 22. A manually engageable button portion 52 is mounted to the housing 50 for movement between an undepressed position as shown in FIG. 4 and one of a fully depressed position as shown in FIG. 6 and a partially depressed position as shown in FIG. 5. The button 52 includes a protruding center portion 54 and four arms 56, 58, 60 and 62 which project radially outwardly from the center portion 54, at 90° intervals. The arms 56, etc. extend outwardly and slope downwardly from the center portion 54 and the center portion 54 protrudes or projects outwardly somewhat from the innermost surfaces of the arms 56, etc. The center portion 54 may advantageously be contoured and sized to be substantially identical in its size and shape to a conventional flipper button usually provided at the sides of pinball machines.

Figure 7:
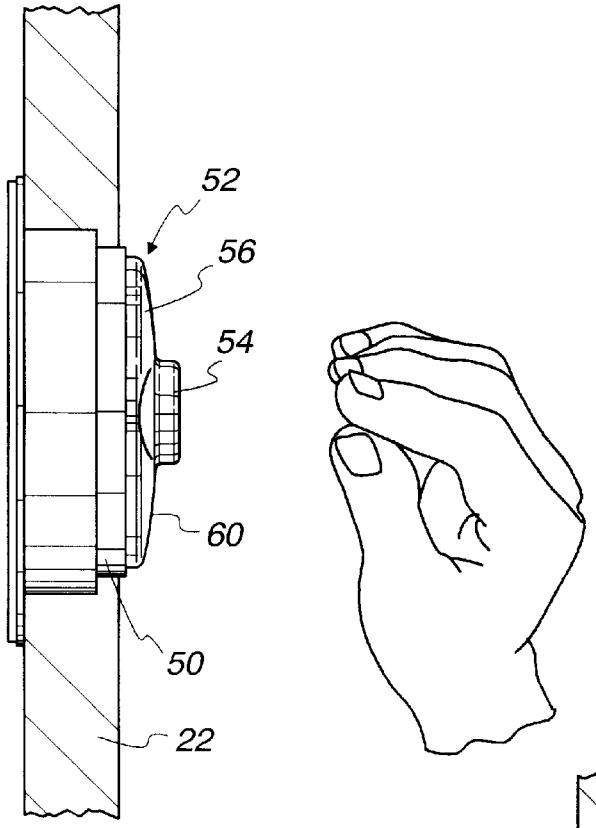
FIG. 7 is a side elevation corresponding to FIG. 4.

A mounting plate or circuitboard 72, which is secured by suitable fasteners to the underside of the housing 50, mounts four switches 74, 76, 78 and 80 which are respectively located substantially centered beneath the four arms 56, etc. of the button 52. Cooperatively, the undersurface of the button 52 includes, substantially centered on each of its arms 56, etc. and in alignment with an upwardly projecting or protruding actuator element 85 of the corresponding one of the switches, a downwardly projecting boss or embossment 86. Preferably, the respective switches 74, etc. are momentary switches such that their actuators 85 are normally biased to an extended position, to thereby normally bias the button 52 to its undepressed condition as shown in FIGS. 4 and 7.

In operation, as shown in FIG. 6, when the center section 54 of the button 52 is depressed, all four of the switches 74, etc. are actuated, thus producing a first type of switching or control signal, which in the illustrated embodiment is used to control the action of the flippers 29. Thus, when a player engages and activates only the center section 54 of the of the button 36 it will have the "feel" of a conventional flipper button. Upon such engagement, as illustrated in FIG. 6, the button 36 will be moved to its fully depressed position relative to the housing 50, which will give a signal for activating only the flippers 29, in conventional fashion.

Figure 8:
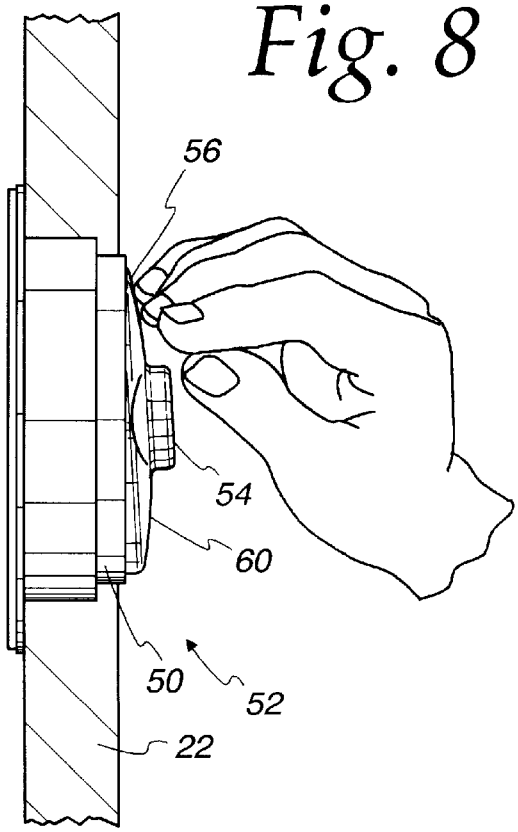
FIG. 8 is a side elevation corresponding to FIG. 5

On the other hand, when the button is engaged by the user so as to only engage and depress one of the four arms 56, etc. the result is as shown in FIGS. 5 and 8, wherein only a corresponding one of the switches 74, etc. is actuated. This latter action produces a second type of switching signal which may be used for various other game features, as described above. In the illustrated embodiment a total of four different ones of these second types of control signal may be provided, one each associated with activation of each of the switches 74, etc. located beneath each of the arms 56, etc. of the button 52.

Optionally, the button 52 may be transparent or translucent such that an illumination device such as a lamp or an LED 70 may be mounted within the housing 50 and beneath the button 52 for selective illumination as desired. The lamp 60 is preferably mounted to the circuitboard or mounting plate 72.

What has been illustrated and described herein is a novel and improved pushbutton control device for use with a pinball type of amusement game. The control device of the invention may be used to produce one of a conventional switching signal for activating elements of the pinball game, or may produce other types of controller switching signals of the game.

What is claimed is:

1. An amusement game comprising:

a cabinet;

apparatus in said cabinet defining pinball play, including a playfield and flippers for propelling a ball on the playfield;

at least one control device for operating the flippers and other features of the amusement game, said at least one control device being manually engageable in at least two different fashions for producing at least two corresponding and different control signals, each fashion of engagement producing at least one corresponding control signal distinguishable from at least one control signal produced in response to each other fashion of engagement;

at least one of said at least two different control signals being for controlling said flippers and at least one other of said at least two different control signals being for controlling other features of said amusement game.

2. The amusement game of claim 1 wherein said control device comprises at least one push-button mounted to said cabinet.

3. The amusement game of claim 1 wherein said control device comprises a push-button mounted on either side of said cabinet.

4. The amusement game of claim 1 wherein said control device comprises:

a housing mounted to said cabinet;

a manually engageable button mounted to said housing for movement between an undepressed position and at least one other position;

said button having a center portion and four arms extending radially outwardly from said center portion;

biasing means acting upon said center portion for normally biasing said button to said undepressed position; and a switch element located beneath each of said four arms of said button and responsive to movement of the corresponding arm between said undepressed position and a depressed position for producing a corresponding signal.

5. The amusement game of claim 4 wherein each of said four arms includes a manually engageable surface, such that one of the center portion and an individual one of said arms may be manually engaged for overcoming said biasing force and moving said one of said center portion and an individual one of said arms from said undepressed position to a position for engaging one or more of said switch elements for producing corresponding signals.

6. The amusement game of claim 4 and further including a mounting plate, said switch elements being mounted to said mounting plate and said mounting plate being secured to an underside of said housing.

7. The amusement game of claim 4 wherein said biasing means comprises an outwardly biased actuator member projecting from each of said switch elements.

8. The amusement game of claim 4 wherein said button and said switch elements are located and configured such that depressing said center portion of said button will activate all four of said switch elements and depressing one of said four arms will activate the corresponding switch element located therebeneath.

9. The amusement game of claim 1 wherein said control device has at least two manually engagable control surfaces and produces at least a first control signal in response to engagement of at least a first one of said control surfaces and at least a second control signal, distinguishable from said first control signal in response to engagement of at least a second one of said control surfaces.

10. A control device for an amusement game comprising a cabinet and apparatus in said cabinet defining pinball play, including a playfield and flippers for propelling a ball onto the playfield, said control device comprising;

at least one push-button for operating the flippers and other features of the amusement game, said at least one push-button being manually engageable in at least two different fashions for producing at least two corresponding and different types of control signals, each fashion of engagement producing at least one corresponding control signal distinguishable from at least one control signal produced in response to each other fashion of engagement;

at least one of said at least two types of control signals being for controlling said flippers and at least one other of said at least two types of control signals being for controlling other features of said amusement game.

11. The control device of claim 10 wherein one said push-button is mounted to either side of said cabinet.

12. The control device of claim 10 wherein said push-button comprises:

a housing mounted to said cabinet;

a manually engageable button mounted to said housing for movement between an undepressed position and at least one other position;

said button having a center portion and four arms extending radially outwardly from said center portion;

biasing means acting upon said center portion for normally biasing said button to said undepressed position; and a switch element located beneath each of said four arms and responsive to movement of the corresponding arm between said undepressed position and a depressed position for producing a corresponding signal.

13. The control device of claim 12 wherein each of said four arms includes a manually engageable surface, such that one of the center portion and an individual one of said arms may be manually engaged for overcoming said biasing force and moving said one of said center portion and an individual one of said arms from said undepressed position to a position for engaging one or more of said switch elements for producing corresponding signals.

14. The control device of claim 12 and further including a mounting plate, said switch elements being mounted to said mounting plate and said mounting plate being secured to an underside of said housing.

15. The control device of claim 12 wherein said biasing means comprises an outwardly biased actuator member projecting from each of said switch elements.

16. The control device of claim 12 wherein said button and said switch elements are located and configured such that depressing said center portion of said button will activate all four of said switch elements and depressing one of said four arms will activate the corresponding switch element located therebeneath.

17. The control device for an amusement game of claim 10 wherein said push-button has at least two manually engagable control surfaces and produces at least a first control signal in response to engagement of at least a first one of said control surfaces and at least a second control signal, distinguishable from said first control signal in response to engagement of at least a second one of said control surfaces.

18. A control device for a pinball game having flippers and other features comprising:

at least one push-button for operating the flippers and other features of the amusement game, said at least one push-button being manually engageable in at least two different fashions for producing at least two correspondings and different types of control signals, each fashion of engagement producing at least one corresponding control signal distinguishable from at least one control signal produced in response to each other fashion of engagement; and at least one of said at least two types of control signals being for controlling said flippers and at least one other of said at least two types of control signals being for controlling other features of said amusement game.

19. The control device of claim 18 wherein said push-button comprises:

a housing mounted to said cabinet;

a manually engageable button mounted to said housing for movement between an undepressed position and at least one other position;

said button having a center portion and four arms extending radially outwardly from said center portion;

biasing means acting upon said center portion for normally biasing said button to said undepressed position; and a switch element located beneath each of said four arms of said button and responsive to movement of the corresponding arm between said undepressed position and a depressed position for producing a corresponding signal.

20. The control device of claim 19 wherein each of said four arms includes a manually engageable surface, such that one of the center portion and an individual one of said arms may be manually engaged for overcoming said biasing force and moving said one of said center portion and an individual one of said arms from said undepressed position to a position for engaging one or more of said switch elements for producing corresponding signals.

21. The control device for a pinball game having flippers and other features of claim 16 wherein said push-button has at least two manually engagable control surfaces and produces at least a first control signal in response to engagement of at least a first one of said control surfaces and at least a second control signal, distinguishable from said first control signal in response to engagement of at least a second one of said control surfaces.

* * * * *